US005613664A

United States Patent [19]

Svalbe

[11] Patent Number: 5,613,664

[45] Date of Patent: Mar. 25, 1997

[54] PLASTIC FENCES AND METHOD FOR PREFABRICATING SUCH FENCES

[76] Inventor: John Svalbe, 2044 Phalarope Ct., Costa Mesa, Calif. 92626

[21] Appl. No.: 316,248

[22] Filed: Sep. 30, 1994

[51] Int. Cl.[6] ..... E04H 17/14

[52] U.S. Cl. ..... 256/19; 256/65; 256/66; 256/DIG. 5

[58] Field of Search ..... 256/19, 65, DIG. 5, 256/66

[56] References Cited

U.S. PATENT DOCUMENTS

| | | | |
|---|---|---|---|
| 2,027,493 | 1/1936 | Thilborger | 256/19 |
| 3,957,250 | 5/1976 | Murphy | 256/19 |
| 4,289,302 | 9/1981 | Montgomery | 256/65 X |
| 4,796,866 | 1/1989 | Garneau | 256/19 X |
| 4,824,077 | 4/1989 | Brickner . | |
| 4,858,891 | 8/1989 | Boes | 256/19 |
| 4,892,292 | 1/1990 | Russell | 256/19 X |
| 5,255,899 | 10/1993 | von Grozny | 256/65 X |
| 5,302,047 | 4/1994 | Ivey . | |
| 5,303,900 | 4/1994 | Zulick, III et al. | 256/19 X |
| 5,404,685 | 4/1995 | Collins | 256/19 X |

OTHER PUBLICATIONS

Heritage Vinyl Products—Sabel 3 Fence Assembly Instructions, May 1992.
Heritage Fence—Brochure, Jan. 1992.
Heritage Vinyl Products—General Installation of Residential Fence.
Heritage Fence—Brochure.
Heritage Fence—Semi-Private & Privacy Fence, Feb. 1992.
Heritage Fence, The Need To Know, Product Specification.

*Primary Examiner*—Terry Lee Melius
*Assistant Examiner*—Christopher J. Novosad
*Attorney, Agent, or Firm*—Price, Gess & Ubell

[57] ABSTRACT

A section of a fence made of plastic, concrete, and steel reinforcement is disclosed. The section includes two posts. Each post has a hollow portion that is filled with concrete and steel reinforcement. The section further includes rails fastened between the two posts, wherein each of the rails has a hollow portion filled with concrete and steel reinforcement. Each of the rails is fastened between the two posts using a pin for each post. A number of pickets are fastened between the rails. Each of the pickets has a hollow portion filled with concrete and steel reinforcement, and the steel reinforcement in each picket extends along the length of the picket and into each of the rails.

18 Claims, 3 Drawing Sheets

PLASTIC FENCES AND METHOD FOR PREFABRICATING SUCH FENCES

BACKGROUND OF THE INVENTION

1. Field of the Invention

The present invention is directed to fence structures and, more particularly, to prefabricated fences having exteriors of plastic and interiors of concrete and steel reinforcement.

2. Description of Related Art

Fences have traditionally been constructed of either wood or wrought iron. A typical fence formed from either of these materials includes a number of fence posts secured into the ground along the length of the fence. Horizontal rails are then attached to the fence posts, and then vertical pickets are attached to the horizontal rails.

Regardless of whether a fence is constructed of wood or wrought iron, a number of fastening means must be used to fasten the rails to the posts and the pickets to the rails. A wooden picket fence may use nails, screws, or bolts, to fasten these elements. Similarly, a wrought iron fence may use rivets, screws, bolts, or welded joints to fasten the various elements together. With either construction, a user must spend a lot of time assembling the fence before the fence is operable.

In addition to the large amount of assembly time required to construct these traditional fences, these fences require substantial maintenance through the years. Wooden fences are subject to rot and deterioration, and wrought iron picket fences are subject to rust and deterioration. To combat these respective problems, wooden and wrought iron fences need a protective coating maintained thereon for an optimal lifetime of use. This coating generally comprises primer and paint, and must be reapplied periodically.

Plastic picket fences have been proposed in the prior art in an attempt to overcome the problems of deterioration and rust associated with wooden and wrought iron fences. Although these plastic fences display excellent resistance to rot and deterioration, these fences are often flimsy and suffer from cumbersome and ineffective assembly requirements.

Adhesives, such as PVC cement, have been used to secure plastic pickets to plastic rails. The technique is ineffective, however, because the plastic pickets can be easily ripped away from the plastic rails.

Rivets have also been used to secure the plastic pickets to the plastic rails. This procedure is cumbersome, since it involves accurately drilling holes in the proper locations in each of the pickets and rails, and then using a rivet gun to connect the pickets to the rails. This construction may provide more strength than adhesive joints, but still suffers from a lack of strength because it allows for movement of the joints. A plastic fence held together by rivets, therefore, may not feel sturdy.

Tabs and indentations have also been used for assembling plastic components. These fastening means may provide convenience but do not offer strength and stability.

The prior art has attempted to make the plastic fences feel sturdy. For example, longitudinal ribs or splines have been formed in the plastic parts of these fences in an attempt to add rigidity. Such constructions, however, do not match the strength and stability of wooden or wrought iron fences.

Others have filled each post of the fence with concrete when the posts are being secured to the ground in a concrete footing. While this approach adds some strength, it still suffers from cumbersome on-site assembly requirements. In one known system, each post has holes for accepting the rails and the ends of the rails are sealed off during application of the concrete into the hollow post. The rails must still be applied to the posts with locking tabs or screws before placement of the concrete.

Moreover, because the concrete is placed only in the posts, the overall fence still suffers from a lack of rigidity. The prior art rails and pickets have not been filled with concrete and steel reinforcement. In fact, the prior art commonly suggests that the ends of the rails be sealed to prevent entry of concrete when concrete is placed in the posts. The prior art has not incorporated any integral formation of the post to the rails and the rails to the pickets using concrete and steel reinforcement.

OBJECTS AND SUMMARY OF THE INVENTION

The picket fence of the present invention is sturdy and can be prefabricated prior to installation. The picket fence derives its strength from prefabricated fence posts and prefabricated fence sections comprising plastic components that are interconnected with reinforcing members and filled with a hardening agent.

A prefabricated fence section of the present invention may comprise, for example, two hollow rails and a number of hollow pickets. Each of the hollow pickets also contains a reinforcement member that extends beyond the picket and into side apertures in two hollow rails. Preferably, each of the hollow rails also contains a reinforcement member. The hollow rails and pickets are securely attached together by a hardening agent that fills their interiors and surrounds the steel reinforcement members.

Each prefabricated fence section is installed, in the field, between two prefabricated fence posts. The post, like the fence sections, are filled with a hardening agent and a reinforcing member.

The rails are preferably fastened between two posts using pins that connect prefabricated pin holes. Each post has a top end and a bottom end, and each rail has a left end and a right end. Transverse pin holes are formed through the posts, and the internal hardening agent, near the top end and the bottom end. Each plastic rail similarly has a prefabricated pin hole formed in the hardening agent at its left and right ends. Each rail is easily joined to a post via a pin which is inserted into both the rail and the post. The pin is beneficially surrounded by the preset hardening agent to firmly situate and locate the plastic rail between the plastic posts.

A preferred method of manufacturing the prefabricated fence sections involves a jig for holding a plurality of pickets between a pair of rails while the hardening agent is poured into the assembly. The jig holds the rails and their reinforcement members in a vertical position with their bottom end plugged. The pickets are held between the rails with their steel reinforcement members protruding into side apertures in the rails. The side apertures are large enough to accommodate the reinforcement members and to allow the hardening agent to pass into the pickets.

The hardening agent is poured into the tops of the rails after the concrete fills the rails and moves through the side apertures into the pickets. A single application of concrete is thus placed throughout the interior of the assembly to securely fasten the pickets to the rails.

The preferred jig includes a frame having a plurality of vertical channels which run alongside the two rails and a plurality of horizontal shelves for supporting the pickets between the two rails. The right-most rail abuts a right edge of the jig. Wedges are then placed in the channels nearest the left-most rail to squeeze the pickets between the two rails.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically.

Figure 1:
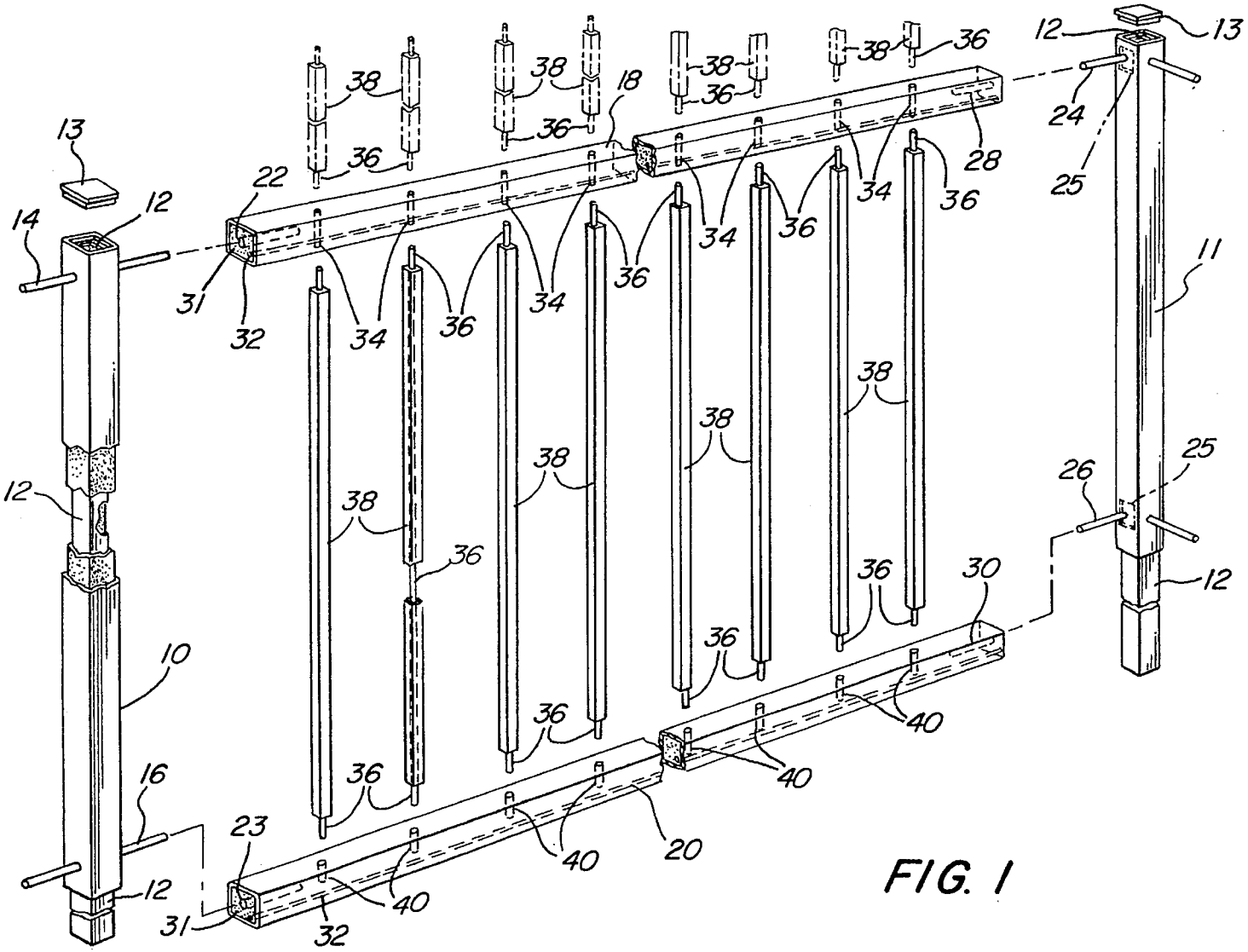
FIG. 1 is an exploded perspective view of two prefabricated fence posts and an intermediate, prefabricated fence section according to the presently preferred embodiment.

FIG. 1 shows a preferred fence assembly according to the present invention. The assembly is comprised of a fence section 9 situated between two posts, a running post 10, and a corner post 11.

Each post is preferably formed of extruded polyvinyl chloride (PVC). The extruded PVC forms an outer shell which is later filled with a reinforcement member, such as a steel tube or rod, and a hardening substance 15, such as concrete. The reinforcement member preferably comprises a rectangular steel bar (solid or hollow).

The reinforcement member 12 is inserted into the hollow portion of the running post 10 to extend below the running post 10. Two holes are drilled through the post 10 and steel reinforcement 12 to accommodate two pins 14, 16. The pins 14, 16 are for supporting the upper rail 18 and the lower rail 20. The hardening agent 15 is then poured into the post 10. The hardening agent 15 surrounds the reinforcement member 12 and contacts the inner surfaces of the PVC post 10. The corner post 11 is similarly constructed. The tops of the posts 10, 11 are preferably covered with end caps 13 formed from injection-molded plastic.

The surface of the post 10 around the pin 14 may be flat so that the rail 18 fits flush thereto, or an indentation or hole 25 may be formed in the post 10 having the same cross-section as that of the rail 18. The post 11 similarly has pins 24, 26 for fitting into apertures 28, 30 of rails 18, 20. The reinforcement member 12 adds strength and rigidity to the posts 10, 11, and, by extending below the posts 10, 11, provides a means for anchoring the posts 10, 11 into the ground, a concrete footing, block wall, or into some other firm substrate.

The pins 14, 16, 24, and 26 are spaced at any desired distance to accommodate the rails 18 and 20. These pins may comprise a steel reinforcement bar, in which case they are permanently formed in the posts 10, 11. As presently preferred, the pins comprise a smooth aluminum cylindrical structure, which may be inserted into and removed from the posts 10, 11.

The posts 10, 11 are preferably manufactured on a jig which supports them in a vertical position. The reinforcement member 12 is inserted into the post 10, holes are drilled through the post 10 and the reinforcement member 12, the pins 14, 16 are inserted in the holes, and the hardening agent is poured into the post 10 to fill the post 10 and surround the reinforcement member 12. The preferred hardening agent is concrete. The preferred pins 14, 16 are made of smooth aluminum rods that are oiled so they can be removed after the concrete has set. In an alternative embodiment, the pins 14, 16 are made from rods with a rough exterior whereby the pins 14, 16 are permanently secured into the post 10 after the concrete has set. In the latter case, the pins 14, 16 are preferably comprised of steel rebar. If desired, the jig could hold the posts in the horizontal position, the hardening material could be inserted under pressure, or both.

The fence section 9, as shown in FIG. 1, is comprised of at least two rails 18, 20 and a plurality of pickets 38. Each of the rails 18, 20 comprises an extruded PVC shell filled with a hardening agent 31 and a reinforcement member 32. A plurality of side apertures 34, 40 are formed in the rails 18, 20 for accommodating the reinforcement members 36 extending from either end of the pickets 38.

In an alternative embodiment, the fence section 9 may have additional horizontal rails with pickets therebetween. A portion of this alternative embodiment is shown with phantom lines in FIG. 1. According to this alternative embodiment, pickets 38' having steel reinforcement 36' fit between the upper rail 18 and an additional rail (not shown). The posts 10, 11 would, of course, extend to a height sufficient to accommodate the additional rail. The steel reinforcement 36' in the pickets 38' of the alternative embodiment fit into apertures in the upper surface of the rail 18 and into apertures in the lower surface of the additional rail (not shown).

The fence section 9 is preferably prefabricated and installed as an integral unit. The preferred fabrication method involves a jig 41 for securing the pickets 38 between the rails 18, 20. The jig 41 is shown supporting two fence sections 9, and may similarly support additional fence sections on the back side of the jig (not shown). The jig 41 is not limited to two fence sections per side.

Figure 2:
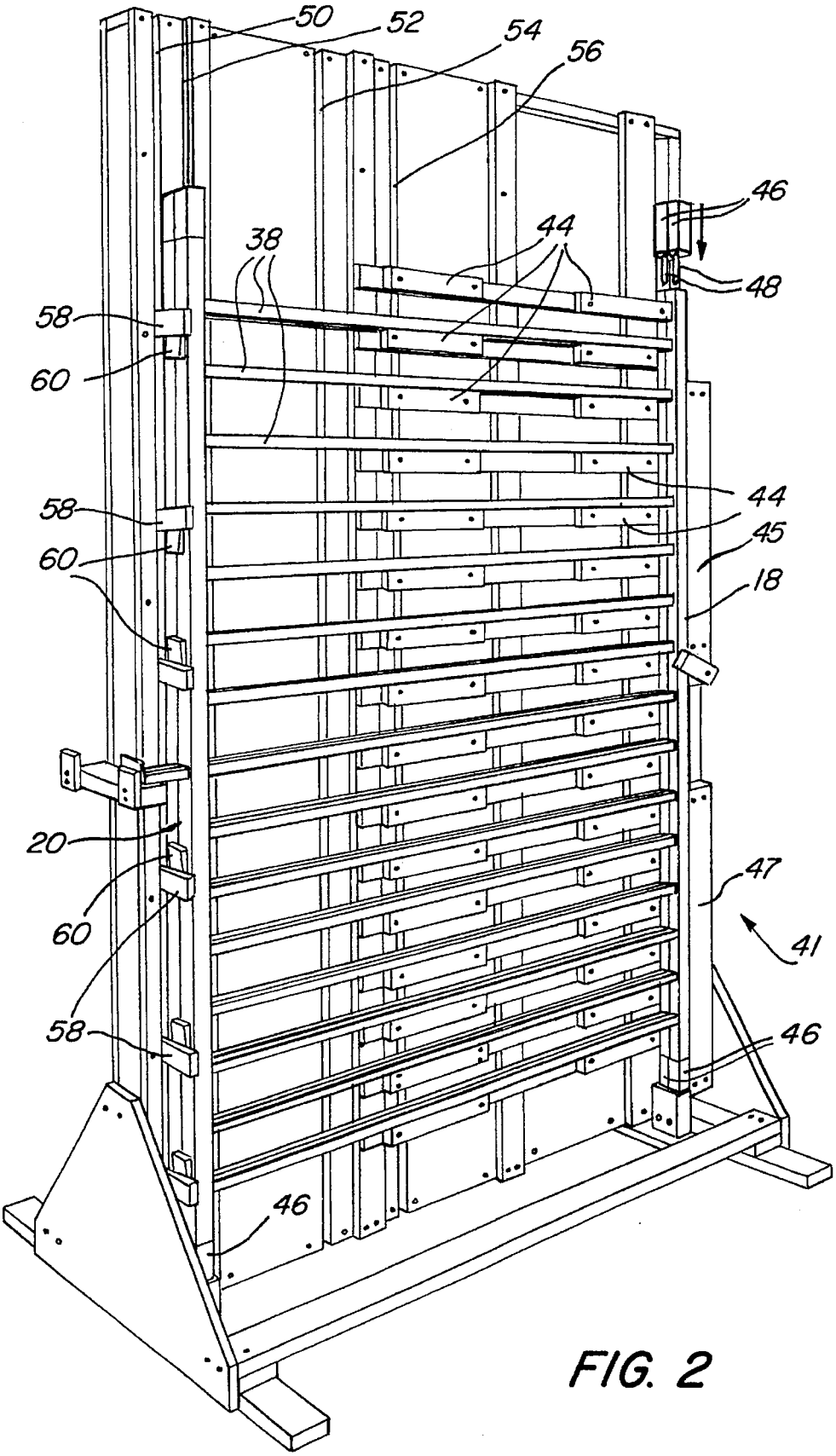
FIG. 2 illustrates a preferred jig for fabricating the fence section of FIG. 1 by assembling the pickets to the rails.

As shown in FIG. 2, the jig 41 comprises a plurality of picket shelves 44. Steel reinforcement 36 is inserted into each picket 38. The steel reinforcement 36 is longer and extends beyond both ends of the picket 38. As with the rectangular steel reinforcement 12 for the posts 10, 11 and the steel reinforcement 32 for the rails 18, 20, the steel reinforcement 36 for the pickets 38 can be round, square, solid, or tubular to provide strength from bending. The picket/reinforcement assemblies 38/36 are then placed on corresponding support shelves 44. The rails 18, 20 are placed on the jig 41 on top of lower dowel blocks 46 on opposite sides of the pickets 38. The steel reinforcement 36 of each picket extends into the apertures 34, 40 of the rails 18, 20. Oiled plastic dowels 46 extend upward from the lower dowel blocks into the bottom openings of the rails 18, 20. Each plastic dowel 48 forms an elongated aperture in the concrete at the ends of the respective rail. When the dowel 46 is removed, an aperture is formed in the rail for accommodating one of the pins of a post. In an alternative embodiment, each dowel block 46 may have a hole therein and remain permanently inside the rail to receive the pins.

A channel is provided on the frame near rail 20. The channel 50 near the rail 20 is for a 60-inch-high fence section, as measured between the two rails 18, 20. As presently preferred, other channels 52, 54, and 56 are provided for rail distances of 58 inches, 48 inches, and 42 inches, respectively, or any other distance that may be required.

As shown in FIG. 2, a number of horizontal wedges 58 are placed into the channel 50, and vertical wedges 60 are placed between the horizontal wedges 58 and the rail 20. The wedges 58, 60 provide a horizontal force, squeezing the pickets 38 between the rail 20 and the rail 18. The rail 18 abuts against an abutting surface which includes members 45 and 47. Alternatively, a similar set of channels and wedges may be used adjacent to the rail 18. In the alternative embodiment shown in FIG. 1 in phantom, where three or more rails are used to form a prefabricated fence section, the members 45 and 47 are replaced with a plurality of small abutting members that fit against the rail 18. Each of these small abutting members contacts the rail 18 at a location to allow the steel reinforcement and/or the pickets to extend through the rail 18 and beyond.

Once the rails 18, 20 are positioned around the pickets 38, with the plastic dowels 48 of the lower dowel blocks 46 extending into the bottoms of the rails 18, 20, concrete is poured into the tops of the rails 18, 20. As presently embodied, a rapid set grout is used. The concrete is thin enough to travel through the rails 18, 20, through the rail apertures 34, 40, and around the steel reinforcement 36 into the pickets 38. The plastic dowels 48 of the upper dowel blocks are then placed into the top openings of the rails 18, 20 to provide apertures for insertion of pins during assembly of the rails to the post. Once the concrete has set, the dowels 46 are removed.

If desired, the jig could hold the rails in the horizontal position, the hardening material could be inserted under pressure, or both.

The jig 41 shown in FIG. 2 thus provides a means of prefabricating a series of pickets between two rails using a single application of concrete. Each prefabricated fence section 9 comprising at least two rails and pickets therebetween is filled with concrete that surrounds, envelops, and grips the steel reinforcement and the interior surfaces of the PVC plastic, to provide a strong and rigid connection of each picket to the rail and thus provide a strong and rigid fence section.

Figure 3:
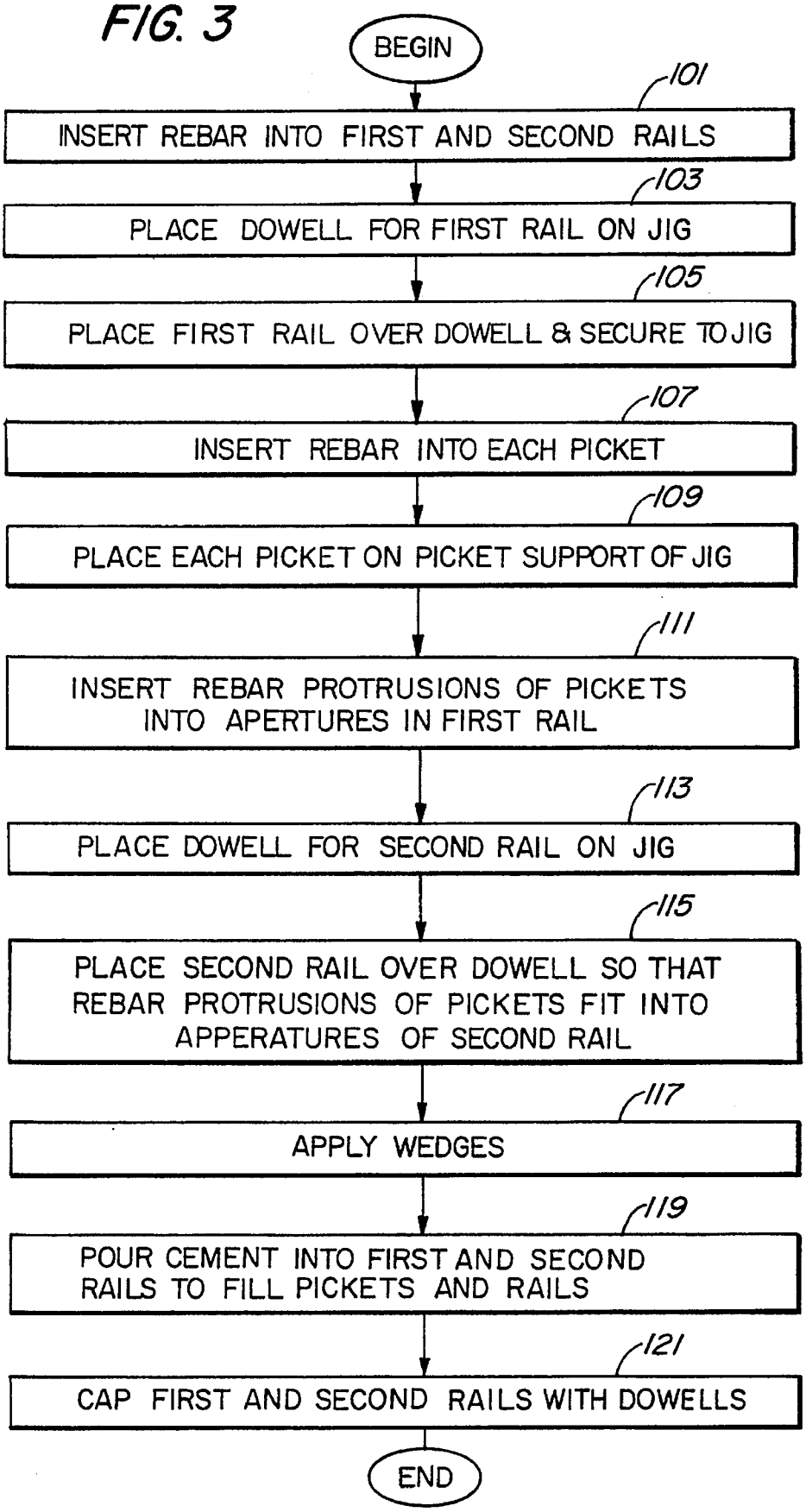
FIG. 3 is a flow chart of the preferred method of manufacturing the prefabricated fence section of FIG. 1 using the jig of FIG. 2.

The method of forming the prefabricated fence section is described with reference to FIG. 3. At step 101, steel reinforcement 32 is inserted into the first and second rails 18. At step 103, the first rail is placed onto the lower dowel block 46 and secured to the rail 18 at step 105. Steel reinforcement 36 is inserted into each picket 38 at step 107, and each picket 38 is placed onto a picket shelf 44 at step 109. At step 111, the protrusions of steel reinforcement 36 are inserted into the apertures 34 in the first rail 18. A plastic dowel 46 is placed at the bottom of the jig at step 113, and the second rail 20 is placed over the dowel 46 and onto the jig so that the steel reinforcement protrusions 36 of the pickets 38 fit into the apertures 40 of the second rail 20 at step 115. The wedges 58, 60 are applied at step 117, and concrete is poured into the first and second rails at step 119. Finally, at step 121, plastic dowels 46 are placed into the top openings of the rails 18, 20.

When the concrete is placed in the rails 18, 20, vibration may or may not be used to facilitate filling of the rails 18, 20 and the pickets 38 with concrete.

Looking back at FIG. 1, a prefabricated section 9, comprising rails 18, 20 and pickets 38, can be assembled between the two posts 10, 11 on a work site. As presently preferred, the pins 14, 16, 24, and 26 are not permanently secured into the posts 10, 11. Thus, these pins 14, 16, 24, and 26 are first placed into the posts 10, 11. The prefabricated section may then be moved against the post 10, thus causing the pins 14, 16 to be inserted into the apertures 22, 23. The pins 24, 26 of the post 11 may similarly be inserted into the apertures 28, 30 of the rails 18, 20. The posts 10, 11 can then be secured into a solid surface, such as an ordinary concrete footing, to secure the fence sections in place between the posts.

The apertures 22, 23, 28, and 30 are preferably larger than the corresponding pins 14, 16, 24, and 26. This allows for easy assembly and for expansion and contraction of the fence along the respective pins due to temperature changes. A strong connection is thus provided with adequate flexibility.

In the alternative embodiment where holes, such as the holes shown in phantom at 25 in FIG. 1, are cut into the posts 10, 11 having sizes to accommodate the rails 18, 20, further movement for expansion and contraction is provided. These square holes provide additional rigidity as well, since the rails 18, 20 do not merely abut against the surfaces of the posts 10, 11, but rather fit snugly into their respective holes in the posts 10, 11. The rails are thus able to move in these holes during expansion and contraction. The rectangular holes may further provide an aesthetic advantage which hides any possible gap left by contraction.

Those skilled in the an will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method of assembling a section of a fence, the fence including a picket having a hollow portion extending along a length of the picket, and further including a pair of rails, each rail having a hollow portion extending along a length of the rail and an aperture connecting a joining surface of the rail to the hollow portion of the rail, the method comprising the following steps:

arranging the rails in a spaced relationship so that their respective apertures face one another;

inserting a strengthening member into the hollow portion of the picket, the strengthening member extending within the hollow portion of the picket along the length of the picket and having protruding portions that protrude out of opposite ends of the picket;

inserting the protruding portions into the apertures until the ends of the picket contact the joining surfaces of the rails, the contacting of the end to the joining surfaces connecting the hollow portions of the picket and the rails for fluid flow; and filling the hollow portions with hardener, the hardener flowing between the hollow portions and around the strengthening member that extends between and connects the hollow portions of the picket and the rails, to thereby secure the picket to the rails.

2. The method of assembling a section of a fence according to claim 1, wherein the step of filling the hollow portions with hardener includes a step of placing a dowel into an end of the rail before the filling step, wherein the dowel is one of a solid dowel and a hollow dowel.

3. The method of assembling a section of a fence according to claim 2, wherein the step of filling the hollow portions with hardener is followed by a step of removing the dowel from the end of the rail after the hardener has cured, the space left by the dowel forming a first receiving means in the rail for receiving a pin.

4. The method of assembling a section of a fence according to claim 3, wherein the method further includes a step of securing a post onto a surface, the post having a second receiving means for receiving the pin.

5. The method of assembling a section of a fence according to claim 4, further including the step of placing the pin into both the first receiving means and the second receiving means to thereby fasten the rail to the post.

6. The method of assembling a section of a fence according to claim 1, wherein the picket comprises plastic.

7. The method of assembling a section of a fence according to claim 6, wherein the plastic comprises polyvinyl chloride.

8. The method of assembling a section of a fence according to claim 1, wherein the strengthening member comprises steel reinforcement.

9. The method of assembling a section of a fence according to claim 1, wherein the hardener comprises concrete.

10. The method of assembling a section of a fence according to claim 1, wherein the rail comprises a hollow portion filled with concrete and steel reinforcement.

11. A prefabricated section of a fence, comprising:

a plurality of pickets, each picket having an abutting end and a hollow portion extending from the abutting end along a length of the picket;

a plurality of picket-strengthening members, each picket-strengthening member extending along the length of the hollow portions and having a part extending beyond the abutting ends of each of the pickets;

a rail having a plurality of joining surfaces surrounding a plurality of apertures, a hollow portion extending along a length of the rail, and a solid rail-strengthening member extending substantially along the entire length of the rail and of a relatively small profile so that a portion of the rail's hollow section remains between an exterior of the rail-strengthening member and an interior of the rail, the apertures connecting the joining surfaces to the hollow portion of the rail and accommodating the extending part of the picket-strengthening members therein;

a hardened substance filling the hollow portions and surrounding the rail and picket-strengthening members to thereby securely fasten the pickets to the rail; the rail including an end that opens into the hollow portion, the end having a first receiving means formed in the hardened substance for receiving a pin.

12. The prefabricated section of a fence according to claim 11, further comprising a post having a second receiving means for receiving the pin.

13. The prefabricated section of a fence according to claim 12, wherein the pin is placed into both the first receiving means and the second receiving means to thereby fasten the rail to the post.

14. A section of a fence, comprising:

a plastic post having a top end and a bottom end;

a first strengthening member running through the plastic post, the strengthening member extending from the top end to the bottom end;

a hardened substance surrounding the first strengthening member;

first receiving means for receiving a pin through the plastic post, the strengthening member, and the hardened substance;

a plastic rail having two opposing ends;

a second strengthening member running through the plastic rail between the two opposing ends;

a hardened substance surrounding the second strengthening member; and second receiving means for receiving the pin into one of the opposing ends of the plastic rail and into the hardened substance of the plastic rail, the pin being surrounded by the substance to thereby hold the plastic rail to the plastic post.

15. The section of a fence according to claim 14, wherein the plastic is polyvinyl chloride, the hardened substance is concrete, and the pin comprises metal.

16. A fence assembly, comprising:

two posts, each having an upper end and a lower end and comprising:

(a) a hollow portion filled with concrete and steel reinforcement;

(b) a first receiving means for receiving a first pin near the upper end of the post; and (c) a second receiving means for receiving a second pin near the lower end of the post; and a fence section having:

an upper rail having a left end and a right end and comprising:

(a) a hollow portion filled with concrete and steel reinforcement;

(b) a third receiving means at the left end for receiving the first pin of one of the two posts;

(c) a fourth receiving means at the right end for receiving the first pin of the other of the two posts; and (d) a plurality of apertures located on a lower surface of the upper rail;

a lower rail having a left end and a right end and comprising:

(a) a hollow portion filled with concrete and steel reinforcement;

(b) a fifth receiving means at the left end for receiving the second pin of one of the two posts; and (c) a sixth receiving means at the right end for receiving the second pin of the other of the two posts;

(d) a plurality of apertures located on a upper surface of the lower rail; and a plurality of pickets, each comprising a hollow portion filled with concrete and steel reinforcement, the steel reinforcement in each hollow portion extending beyond the hollow portion and into an aperture on the upper surface of the lower rail and an aperture on the lower surface of the upper rail.

17. A fence assembly, comprising:

two posts, each having a hollow portion filled with concrete and steel reinforcement;

rails fastened between the two posts, each of the rails having a plurality of side apertures and a hollow portion filled with concrete and steel reinforcement and being fastened to a respective one of the two posts via a pin; and a plurality of pickets fastened between the rails, each of the pickets having a hollow portion filled with concrete and steel reinforcement, the steel reinforcement in each picket extending along the length of the picket and into opposite ones of the plurality of side apertures in each of the rails.

18. A fence assembly comprising:

a pair of elongated hollow plastic rails arranged in a spaced relationship to one another;

a plurality of side apertures running along a length of each hollow plastic rail, the plurality of side apertures of one rail facing the plurality of side apertures of the other rail;

a plurality of pickets having opposed ends of a relatively large profile and solid opposed extensions of a smaller profile than said opposed ends arranged between said pair of elongated hollow plastic rails with the solid opposed extensions of said pickets extending into the elongated hollow plastic rails through opposites ones of the plurality of side apertures of said hollow plastic rails until the opposed ends are abutting the hollow plastic rails; and a hardening material located inside of the elongated hollow plastic rails that fill the plastic rails and surround the solid opposed extensions to solidify the hollow plastic rails and secure the solid opposed extensions of said pickets therein; an elongated hollow plastic fence post; a hardening material located inside of the elongated hollow plastic fence post that fills the fence post; means for connecting an end of each plastic rail to a side of the plastic fence post; an end hole formed in the hardening material located at an end of each hollow rail; a corresponding side hole formed in a side of the fence post; and a pin inserted into the end hole of the hollow rail and the side hole of the fence post.

* * * * *